US008142621B2

(12) United States Patent
Larsson et al.

(10) Patent No.: US 8,142,621 B2
(45) Date of Patent: Mar. 27, 2012

(54) INSERT FOR MILLING OF CAST IRON

(75) Inventors: Andreas Larsson, Fagersta (SE); Tommy Larsson, Angelsberg (SE); Jon Andersson, Vasteras (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 13/239,958

(22) Filed: Sep. 22, 2011

(65) Prior Publication Data

US 2012/0009039 A1 Jan. 12, 2012

Related U.S. Application Data

(62) Division of application No. 12/207,883, filed on Sep. 10, 2008, now Pat. No. 8,084,148.

(30) Foreign Application Priority Data

Sep. 13, 2007 (SE) ..... 0702043

(51) Int. Cl.
*C23C 16/00* (2006.01)

(52) U.S. Cl. ..... 204/192.16; 204/192.15; 407/119; 427/419.7

(58) Field of Classification Search ..... 204/192.15, 204/192.16; 407/119; 427/419.7
See application file for complete search history.

(56) References Cited

U.S. PATENT DOCUMENTS

| | | | |
|---|---|---|---|
| 5,656,383 | A | 8/1997 | Tanaka |
| 5,750,247 | A | 5/1998 | Bryant |
| 6,761,750 | B2 | 7/2004 | Zackrisson |
| 6,884,497 | B2 | 4/2005 | Sulin |
| 7,094,479 | B2 | 8/2006 | Sato |
| 7,431,977 | B2 | 10/2008 | Hessman |
| 7,767,319 | B2 | 8/2010 | Åkesson |
| 2004/0214050 | A1 | 10/2004 | Zackrisson |
| 2007/0154739 | A1 | 7/2007 | Martensson |
| 2007/0160843 | A1 | 7/2007 | Martensson |
| 2008/0050186 | A1 | 2/2008 | Westergren |

FOREIGN PATENT DOCUMENTS

| | | |
|---|---|---|
| EP | 1205569 | 5/2002 |
| EP | 1103635 | 8/2004 |
| EP | 1470879 | 10/2004 |
| EP | 1493845 | 1/2005 |
| EP | 1655391 | 5/2006 |
| EP | 1798308 | 6/2007 |
| EP | 1798310 | 6/2007 |
| EP | 1867741 | 12/2007 |
| EP | 1347076 | 2/2008 |
| EP | 1900849 | 3/2008 |
| JP | 09-295204 | 11/1997 |
| JP | 2003-127003 | 5/2003 |
| JP | 2006-281363 | 10/2006 |
| WO | 97/20081 | 6/1997 |
| WO | 97/20083 | 6/1997 |
| WO | 2007069973 | 6/2007 |

*Primary Examiner* — Archene Turner
(74) *Attorney, Agent, or Firm* — Young & Thompson

(57) ABSTRACT

A coated cemented carbide insert is particularly useful for milling of cast iron, methods for making the insert, and methods of their use are disclosed. The insert is formed by a composition of the substrate of about 5-7 wt % Co, about 0.05-20 wt % total amount of the metals selected from the group consisting of Ti, Nb, Ta and combination thereof, and balance WC with a coercivity (Hc) of 1 about 4-19 kA/m and an S-value of about 0.81-0.96. The coating includes a homogeneous layer of $(Ti_xAl_{1-x})N$, where x is between about 0.25 and abut 0.50 with a crystal structure of NaCl type and a total thickness of between about 1.0 and about 5.0 μm as measured on the middle of the flank face.

19 Claims, 1 Drawing Sheet

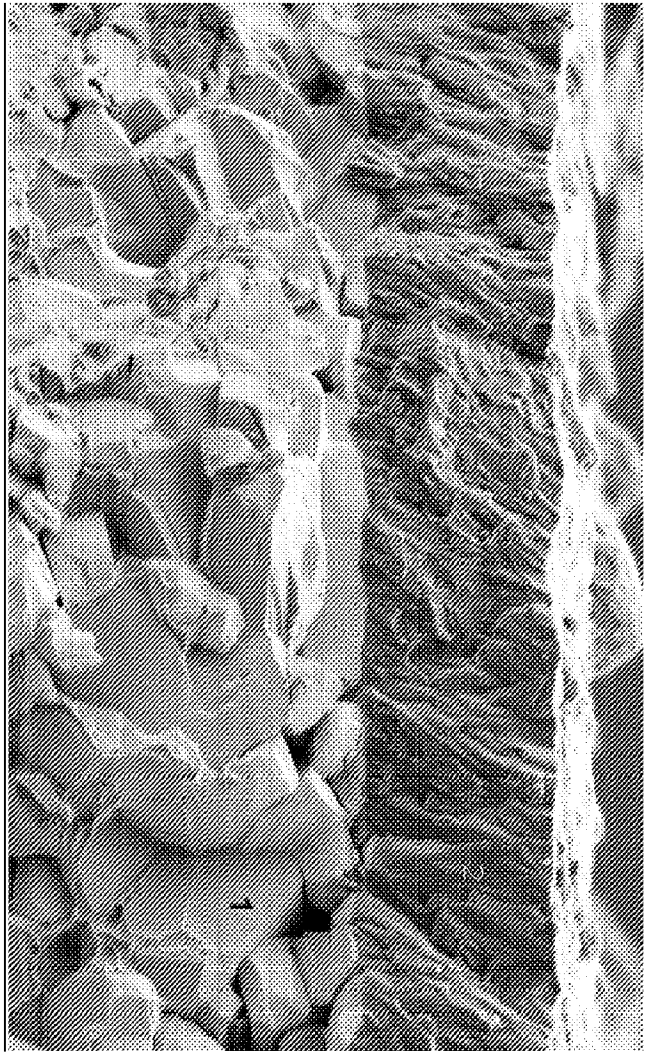

INSERT FOR MILLING OF CAST IRON

CROSS REFERENCE TO RELATED APPLICATIONS

This application is a division of application Ser. No. 12/207,883 filed on Sep. 10, 2008; which claimed priority to Swedish application 0702043-1 filed Sep. 13, 2007. The entire contents of each of the above-identified applications are hereby incorporated by reference.

FIELD OF THE INVENTION

The present invention relates to coated cemented carbide milling inserts for wet or dry machining of cast iron, such as nodular cast irons.

BACKGROUND OF THE INVENTION

During milling of various materials with coated cemented carbide cutting tools, the cutting edges are regarded as being worn according to different wear mechanisms. Wear types, such as chemical wear, abrasive wear and adhesive wear, are rarely encountered in a pure state, and complex wear patterns are often the result. The domination of any of the wear mechanisms is determined by the application, and is dependent on properties of the machined material, applied cutting parameters, and the properties of the tool material. The machinability of cast irons can vary considerably between the various groups but also within a certain group. Small variation in the chemical composition or the micro-structure, related to the casting technique, can have significant influence on the tool life.

In general, the different cast irons are very demanding when it comes to wear resistance and therefore chemical vapor deposition (CVD)-coated inserts have been commonly used. However, in some applications these inserts do not have the combination of edge toughness and wear resistance needed.

EP 1205569 discloses a coated milling insert particularly useful for milling of grey cast iron with or without cast skin under wet conditions at low and moderate cutting speeds and milling of nodular cast iron and compacted graphite iron with or without cast skin under wet conditions at moderate cutting speeds. The insert is characterised by a WC—Co cemented carbide with a low content of cubic carbides and a highly W-alloyed binder phase and a coating including an inner layer of $TiC_xN_y$ with columnar grains followed by a layer of $\kappa$-$Al_2O_3$ and a top layer of TiN.

EP 1655391 discloses coated milling inserts particularly useful for milling of grey cast iron with or without cast skin under dry conditions at preferably rather high cutting speeds and milling of nodular cast iron and compacted graphite iron with or without cast skin under dry conditions at rather high cutting speeds. The inserts are characterised by a WC—Co cemented carbide with a low content of cubic carbides and a highly W-alloyed binder phase and a coating including an inner layer of $TiC_xN_y$ with columnar grains followed by a wet blasted layer of $\alpha$-$Al_2O_3$.

What is needed is a coated cutting tool with enhanced performance for wet or dry milling of cast irons. The invention is directed to these, as well as other, important needs.

SUMMARY OF THE INVENTION

Accordingly, the invention is directed to cutting tool inserts with a cemented carbide substrate with a relatively low amount of cubic carbides, with a relatively low binder phase content, that is medium to highly alloyed with W and a fine to medium WC grain size. This substrate is provided with a wear resistant coating comprising a $(Ti_xAl_{1-x})N$ layer.

In one aspect, the invention is directed to cutting inserts for milling of cast iron, comprising:

a cemented carbide substrate; and a coating;

wherein said substrate comprises:

about 5 wt % to about 7 wt % Co;

about 0.05 wt % to about 2.0 wt % metals selected from the group consisting of Ti, Nb, Ta, and combinations thereof; and balance WC;

wherein said substrate has a coercivity (Hc) of about 14 kA/m to about 19 kA/m and an S-value of about 0.81 and about 0.96; and wherein said coating comprises a homogeneous layer of $(Ti_xAl_{1-x})N$;

wherein x is between about 0.25 and about 0.50;

wherein said homogeneous layer of $(Ti_xAl_{1-x})N$ has a crystal structure of NaCl type and a total thickness of between about 1.0 μm and about 5.0 μm, as measured on the middle of a face.

In another aspect, the invention is directed to methods of making a cutting insert, comprising a cemented carbide substrate and a coating wherein said cemented carbide substrate comprises about 5 wt % to about 7 wt % Co;

about 0.05 wt % to about 2.0 wt % metals selected from the group consisting of Ti, Nb, Ta, and combinations thereof; and balance WC;

wherein said substrate has a coercivity (Hc) of about 14 kA/m to about 19 kA/m and an S-value of about 0.81 and about 0.96;

said method comprising the step of:

depositing a coating comprising:

a homogeneous layer of $(Ti_xAl_{1-x})N$;

wherein x is between about 0.25 and about 0.50;

wherein said homogeneous layer of $(Ti_xAl_{1-x})N$ has a crystal structure of NaCl type and a total thickness of between about 1.0 μm and about 5.0 μm, as measured on the middle of a face;

using arc evaporation of an alloyed cathode or a composite cathode, wherein said alloyed or composite cathode composition comprises about 25 at. % to 50 at. % Ti, at an evaporation current of between about 50 A and about 200 A depending on cathode size and cathode material having a substrate bias of between about −20 V and about −35 V and a temperature of between about 400° C. and about 700° C., in an $Ar+N_2$ atmosphere comprising about 0 vol. % to about 50 vol. % Ar, at a total pressure of about 1.0 Pa to about 7.0 Pa.

In yet other aspects, the invention is directed to methods for milling of nodular cast iron in both wet and dry conditions, comprising the step of:

using a cutting tool insert described herein at a cutting speed of about 75 m/min to about 300 m/min and feed per tooth of about 0.05 mm to about 0.4 mm.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 1 shows in 40000× a scanning electron microscopy image of a fracture cross section of a cemented carbide insert according to the present invention in which 1. Cemented carbide body and
2. $(Ti_xAl_{1-x})N$ layer.

DETAILED DESCRIPTION OF THE INVENTION

According to the present invention a coated cutting tool insert is provided consisting of a cemented carbide body and a coating. The cemented carbide body has a composition of about 5-7, preferably about 5.5-6.5, more preferably about 5.8-6.2 wt % Co, about 0.05-2.0 wt %, preferably about 0.08-1.5 wt %, more preferably about 0.1-1.2 wt % total amount of the metals selected from the group consisting of Ti, Nb, Ta, and combinations thereof, and balance WC.

In a preferred embodiment, the content of Ti and Nb is on a level corresponding to a technical impurity.

The coercivity (Hc) of the cemented carbide is about 14-19 kA/m, preferably about 14.8-18.3 kA/m.

The cobalt binder phase is medium to highly alloyed with tungsten. The content of W in the binder phase may be expressed as the S-value=σ/16.1, where σ is the measured magnetic moment of the binder phase in $\mu Tm^3kg^{-1}$. The S-value depends on the content of tungsten in the binder phase and increases with a decreasing tungsten content. Thus, for pure cobalt, or a binder in a cemented carbide that is saturated with carbon, S=1, and for a binder phase that contains W in an amount that corresponds to the borderline to formation of phase, S=0.78.

The cemented carbide body has an S-value of about 0.81-0.96, preferably about 0.84-0.95, more preferably about 0.85-0.95.

The coating comprises a layer of $(Ti_xAl_{1-x})N$, where x is between about 0.25 and about 0.50, preferably between about 0.30 and about 0.40, most preferably between about 0.33 and about 0.35. The crystal structure of the (Ti,Al)N-layer is of NaCl type. The total thickness of the layer is between about 1.0 and about 5.0 μm, preferably between about 1.5 and about 4.0 μm. The thickness is measured on the middle of the flank face.

In a preferred embodiment, the layer is strongly textured in the (200)-direction, with a texture coefficient TC(200) larger than about 1.3, preferably between about 1.5 and about 2.5.

The texture coefficient (TC) is defined as follows:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection $I_O$(hkl)=standard intensity according to JCPDS card no 38-1420 n number of reflections used in the calculation (hkl) reflections used are: (111), (200), (220).

In a further preferred embodiment, the layer is in compressive residual stress with a strain of about $2.5\times10^{-3}$–$5.0\times10^{-3}$, preferably about $3.0\times10^{-3}$–$4.0\times10^{-3}$.

In an alternative embodiment, a layer of TiN between about 0.1 and about 0.5 μm thick is deposited on the final $(Ti_xAl_{1-x})N$ layer.

The present invention also relates to a method of making a cutting insert by powder metallurgical technique, wet milling of powders forming hard constituents and binder phase, compacting the milled mixture to bodies of desired shape and size and sintering, comprising a cemented carbide substrate and a coating. According to the method a substrate is provided comprising about 5-7, preferably about 5.5-6.5, more preferably about 5.8-6.2 wt % Co, about 0.05-2.0 wt %, preferably about 0.08-1.5 wt %, more preferably about 0.1-1.2 wt % total amount of the metals selected from the group consisting of Ti, Nb, Ta, and combinations thereof, and balance WC.

In a preferred embodiment, the content of Ti and Nb is on a level corresponding to a technical impurity.

The manufacturing conditions are chosen to obtain an as-sintered structure with a coercivity, Hc, within about 14-19 kA/m, preferably about 14.8-18.3 kA/m and with a S-value within about 0.81-0.96, preferably about 0.84-0.95, most preferably about 0.85-0.95.

Onto this substrate is deposited a coating comprising a $(Ti_xAl_{1-x})N$ layer, where x is between about 0.25 and about 0.50, preferably between about 0.30 and about 0.40, most preferably between about 0.33 and about 0.35. The crystal structure of the (Ti,Al)N-layer is of NaCl type. The total thickness of the layer is between about 1.0 and about 5.0 μm, preferably between about 1.5 and about 4.0 μm. The thickness is measured on the middle of the flank face.

In a preferred embodiment, the method used to grow the layer is based on arc evaporation of an alloyed, or composite cathode, under the following conditions: The Ti+Al cathode composition is about 25 to about 50 atomic share (at. %) Ti, preferably about 30 to about 40 at. % Ti, most preferably about 33 to about 35 at. % Ti.

Before coating, the surface is cleaned preferably by applying a soft ion etching. The ion etching is performed in an Ar atmosphere or in a mixture of Ar and $H_2$.

The evaporation current is between about 50 A and about 200 A depending on cathode size and cathode material. When using cathodes of about 63 mm in diameter the evaporation current is preferably between about 60 A and about 100 A. The substrate bias is between about −20 V and about −35 V. The deposition temperature is between about 400° C. and about 700° C., preferably between about 500° C. and about 600° C.

The (Ti,Al)N-layer is grown in an $Ar+N_2$ atmosphere consisting of about 0-50 vol. % Ar, preferably about 0-20 vol. %, at a total pressure of about 1.0 Pa to about 7.0 Pa, preferably about 3.0 Pa to about 5.5 Pa.

On top of the (Ti,Al)N-layer a TiN-layer of between about 0.1 and about 0.5 μm thickness may be deposited using Arc evaporation as known.

In a further preferred embodiment, the cutting tool insert as described above is treated after coating with a wet blasting or brushing operation, such that the surface quality of the coated tool is improved.

The present invention also relates to the use of a cutting tool insert according to above in milling of nodular cast iron, in both wet and dry conditions with a cutting speed of about 75-300 m/min and feed per tooth of about 0.05-0.4 mm.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned hereunder are incorporated herein by reference. Unless mentioned otherwise, the techniques employed or contemplated herein are standard methodologies well known to one of ordinary skill in the art. The materials, methods, and examples are illustrative only and not limiting.

The present invention is further defined in the following Examples, in which all parts and percentages are by weight and degrees are Celsius, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

Example 1

Grade A: A cemented carbide substrate in accordance with the invention with the composition 6 wt % Co, 0.2 Ta and balance WC, a binder phase alloyed with W corresponding to an S-value of 0.92 was produced by conventional milling of powders, pressing of green compacts and subsequent sintering at 1430° C. The Hc value for the cemented carbide was 16.5 kA/m, corresponding to a mean intercept length of about 0.65 μm. The substrate was coated in accordance with the invention with a (Ti,Al)N-layer, deposited by using cathodic arc evaporation. The layer was deposited using a Ti+Al cathode composition of 33 at. % Ti and the (Ti,Al)N layer was grown in an $Ar+N_2$ atmosphere. The thickness of the coating was 2.8 μm, when measured on the middle of the flank face. X-ray diffraction showed that the (Ti,Al)N layer had a TC(200) of 1.8. FIG. 1 shows in 40000× a scanning electron microscopy image of a fracture cross section of the coated cemented carbide.

Grade B: A substrate with composition 6 wt % Co, 0.2 Ta and balance WC, a binder phase alloyed with W corresponding to an S-value of 0.92, and a Hc value of 16.4 kA/m was coated with a 0.3 μm thick layer of TiN layer, a 4.2 μm thick layer of columnar MTCVD $TiC_xN_y$, and a 3.5 μm thick layer of $\alpha$-$Al_2O_3$ deposited at about 1000° C.

Inserts of grade A and B were tested in a square shoulder milling operation in a nodular cast iron.

| | |
|---|---|
| Operation | Square shoulder milling |
| Cutter diameter | 45 mm |
| Work piece | Bridge |
| Material | GGG 60 |
| Insert type | XOMX180608TR-MD15 |
| Cutting speed | 181 m/min |
| Feed | 0.25 mm/tooth |
| Depth of cut | 14 mm |
| Width of cut | 12 mm |
| Coolant | No |

| Results | Tool life (pieces) |
|---|---|
| Grade A (grade according to invention) | 1000 |
| Grade B | 700 |

The tool life of Grade A was limited by flank wear. The tool life of Grade B was limited by the combination of flank wear, chipping and thermal cracking.

Example 2

Grade C: A substrate with composition 7.6 wt % Co, 0.9 Ta, 0.3 Nb and balance WC, a binder phase alloyed with W corresponding to an S-value of 0.90, and a Hc value of 14 kA/m was coated with a 0.1 μm thick layer of TiN, a 2.8 μm thick layer of columnar MTCVD $TiC_xN_y$, a 2.1 μm thick layer of $\alpha$-$Al_2O_3$ and a 0.5 μm thick layer of TiN, deposited at about 1000° C.

Grade D: A substrate with composition 8.1 wt % Co, 1.1 Ta, 0.3 Nb and balance WC, a binder phase alloyed with W corresponding to an S-value of 0.89, and a Hc value of 15 kA/m was combined with a coating according to Grade A.

Inserts of Grade A, B, C, and D were tested in a shoulder milling operation in a compacted graphite iron material.

| | |
|---|---|
| Operation | Rough shoulder milling |
| Cutter diameter | 63 mm |
| Component | Pump housing |
| Material | CGI |
| Insert type | XOMX180608TR-M14 |
| Cutting speed | 190 m/min |
| Feed | 0.22 mm/tooth |
| Depth of cut | 9.5 mm |
| Width of cut | 51 mm |
| Coolant | No |

| Results | Tool life (pieces) |
|---|---|
| Grade A (grade according to invention) | 116 |
| Grade B | 70 |
| Grade C | 24 |
| Grade D | 65 |

The tool life of Grades A and D was limited by flank wear. The tool life of Grades B and C was limited by the combination of flank wear, chipping and thermal cracking.

Example 3

Inserts of Grade A and B were tested in a face milling operation performed with a disc mill in nodular cast iron.

| | |
|---|---|
| Operation | Face milling |
| Cutter diameter | 180 mm |
| Material | FGS 400.12 |
| Insert type | 335.18-1005T |
| Cutting speed | 100 m/min |
| Feed | 0.10 mm/tooth |
| Depth of cut | 2 mm |
| Width of cut | 22 mm |
| Coolant | Yes |

| Results | Tool life (pieces) |
|---|---|
| Grade A (grade according to invention) | 5480 |
| Grade B | 4500 |

The tool life of Grade A was limited by flank wear. The tool life of Grade B was limited by the combination of flank wear and delamination of the coating.

When ranges are used herein for physical properties, such as molecular weight, or chemical properties, such as chemical formulae, all combinations and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

The invention claimed is:

1. A method of making a cutting insert, comprising a cemented carbide substrate and a coating, said cemented carbide substrate comprising about 5 wt % to about 7 wt % Co;

about 0.05 wt % to about 2.0 wt % metals selected from the group consisting of Ti, Nb, Ta, and combinations thereof; and balance WC;

wherein said substrate has a coercivity (Hc) of about 14 kA/m to about 19 kA/m and an S-value of about 0.81 and about 0.96;

said method comprising:

depositing a coating comprising:

a homogeneous layer of (TixAh-x)N;

wherein x is between about 0.25 and about 0.50;

wherein said homogeneous layer of $(Ti_xAl_{1-x})N$ has a crystal structure of NaCl symmetry and a total thickness of between about 1.0 11 m and about 5.0 11 m, as measured on a middle of a face;

via arc evaporation of an alloyed cathode or a composite cathode, wherein said alloyed or composite cathode composition comprises about 25 at. % to 50 at. % Ti, at an evaporation current of between about 50 A and about 200 A depending on cathode size and cathode material having a substrate bias of between about −20 V and about −35 V and a temperature of between about 400° C. and about 700° C., in an $Ar+N_2$ atmosphere comprising about 0 vol. % to about 50 vol. % Ar, at a total pressure of about 1.0 Pa to about 7.0 Pa.

2. The method according to claim 1, wherein said alloyed or composite cathode composition comprises about 30 to 40 at. % Ti.

3. The method according to claim 1, wherein said temperature is about between 500° C. and about 600° C.

4. The method according to claim 1, wherein said $Ar+N_2$ atmosphere comprising about 0 vol. % and about 20 vol. %.

5. The method according to claim 1, wherein said total pressure is about 3.0 Pa to about 5.5 Pa.

6. The method according to claim 1, wherein said level of Ti and said level of Nb is on a level corresponding to technical impurity.

7. The method according to claim 1, further comprising:

depositing an outermost layer of TiN via arc evaporation;

wherein said outermost layer has a thickness of between about 0.1 μm and 0.5 μm

8. A method for milling of nodular cast iron in both wet and dry conditions, comprising:

providing a cutting tool insert comprising a cemented carbide substrate; and a coating;

wherein said substrate comprises:

about 5 wt % to about 7 wt % Co;

about 0.05 wt % to about 2.0 wt % metals selected from the group consisting of Ti, Nb, Ta, and combinations thereof; and balance WC;

wherein said substrate has a coercivity (Hc) of about 14 kA/m to about 19 kA/m and an S-value of about 0.81 and about 0.96; and wherein said coating comprises:

a homogeneous layer of $(Ti_xAl_{1-x})N$;

wherein x is between about 0.25 and about 0.50;

wherein said homogeneous layer of $(Ti_xAl_{1-x})N$ has a crystal structure of NaCl type and a total thickness of between about 1.0 μm and 5.0 μm, as measured on the middle of a face; and cutting at a cutting speed of about 75 m/min to about 300 m/min and feed per tooth of about 0.05 mm to about 0.4 mm.

9. The method according to claim 8, wherein said Co is present at a level of about 5.5 wt % to about 6.5 wt %.

10. The method according to claim 8, wherein said metals selected from the group consisting of Ti, Nb, Ta, and combinations at a level of about 0.08 wt % and about 1.5 wt %.

11. The method according to claim 8, wherein said substrate has a coercivity (Hc) of about 14.8 kA/m and about 18.3 kA/m and an S-value of about 0.84 to about 0.95.

12. The method according to claim 8, wherein said substrate has an S-value of about 0.84 to about 0.95.

13. The method according to claim 8, wherein x is between about 0.30 and about 0.40.

14. The method according to claim 8, wherein said homogeneous layer of $(Ti_xAl_{1-x})N$, has a total thickness of between about 1.5 μm and about 4.0 μm as measured on the middle of a flank face.

15. The method according to claim 8, wherein said homogeneous layer of $(Ti_xAl_{1-x})N$ has a texture coefficient TC(200) greater than about 1.3;

wherein the texture coefficient (TC) is:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection;

$I_O$(hkl)=standard intensity according to JCPDS card no 38-1420;

n=number of reflections used in the calculation;

(hkl) reflections used are: (111), (200), (220).

16. The method according to claim 8, wherein said homogeneous layer of $(Ti_xAl_{1-x})N$ has a residual strain of between about $2.5\times10^{-3}$ and about $5.0\times10^{-3}$.

17. The method according to claim 8, wherein said homogeneous layer of $(Ti_xAl_{1-x})N$ has a residual strain of between about $3.0\times10^{-3}$ and $4.0\times10^{-3}$.

18. The method according to claim 8, wherein said level of Ti and said level of Nb is on a level corresponding to technical impurity.

19. The method according to claim 8, wherein said coating further comprises an outermost layer of TiN; and wherein said outermost layer is between about 0.1 μm and 0.5 μm thick.

* * * * *